US011504996B2

(12) United States Patent
Benn

(10) Patent No.: US 11,504,996 B2
(45) Date of Patent: Nov. 22, 2022

(54) PAINT REMOVAL UNIT

(71) Applicant: Shawn Allen Benn, Little Elm, TX (US)

(72) Inventor: Shawn Allen Benn, Little Elm, TX (US)

(73) Assignee: Nallen Holdings, LLC, Little Elm, TX (US)

( * ) Notice: Subject to any disclaimer, the term of this patent is extended or adjusted under 35 U.S.C. 154(b) by 0 days.

(21) Appl. No.: 16/710,704

(22) Filed: Dec. 11, 2019

(65) Prior Publication Data

US 2020/0307301 A1 Oct. 1, 2020

Related U.S. Application Data

(60) Provisional application No. 62/826,054, filed on Mar. 29, 2019.

(51) Int. Cl.

| | |
|---|---|
| ***H05B 3/06*** | (2006.01) |
| ***B44D 3/16*** | (2006.01) |
| ***F24H 3/04*** | (2022.01) |
| *H05B 3/00* | (2006.01) |

(52) U.S. Cl.

CPC ..... *B44D 3/168* (2013.01); *F24H 3/0405* (2013.01); *H05B 3/06* (2013.01); *F24H 3/0417* (2013.01); *H05B 3/0033* (2013.01); *H05B 3/0038* (2013.01); *H05B 3/0061* (2013.01); *H05B 3/0071* (2013.01)

(58) Field of Classification Search

None

See application file for complete search history.

(56) References Cited

U.S. PATENT DOCUMENTS

| | | | | | |
|---|---|---|---|---|---|
| 2,221,318 | A * | 11/1940 | Worthing | B44D 3/168 | 392/409 |
| 2,497,535 | A * | 2/1950 | Carlino | B44D 3/168 | 219/228 |
| 2,765,531 | A * | 10/1956 | Campbell, Jr. | B44D 3/168 | 30/140 |
| 4,421,048 | A * | 12/1983 | Adema | B63B 59/06 | 114/222 |
| 4,435,637 | A * | 3/1984 | de Vries | F26B 13/10 | 392/417 |
| 4,806,194 | A * | 2/1989 | Wald | B29C 66/1122 | 126/271.2 A |
| 5,239,613 | A * | 8/1993 | Motev | B41F 15/12 | 101/115 |
| 5,249,255 | A * | 9/1993 | Fuqua | B41F 15/12 | 101/115 |
| 5,335,308 | A * | 8/1994 | Sorensen | F26B 3/30 | 250/491.1 |
| 5,444,813 | A * | 8/1995 | Stehling | H05B 3/06 | 219/541 |

(Continued)

FOREIGN PATENT DOCUMENTS

GB 000110615 A * 10/1917

*Primary Examiner* — Joseph M. Pelham

(74) *Attorney, Agent, or Firm* — Carlson, Gaskey & Olds, P.C.

(57) ABSTRACT

A system for coating removal comprises a frame having a platform extending within the frame. A plurality of heat lamps are mounted on the platform. The plurality of heat lamps are arranged to provide a heat density of at least 40 watts per square inch. A method of removing a coating is also disclosed.

13 Claims, 12 Drawing Sheets

(56) References Cited

U.S. PATENT DOCUMENTS 5,553,189 A * 9/1996 Stegemeier ..... B09C 1/06 219/213
5,590,238 A * 12/1996 Ericson ..... B44D 3/166 134/38
5,789,755 A * 8/1998 Bender ..... B08B 7/0042 134/1
6,174,388 B1 * 1/2001 Sikka ..... C21D 1/09 148/224
6,304,721 B1 * 10/2001 Ericson ..... B44D 3/168 392/410
6,432,555 B1 * 8/2002 Sikka ..... C21D 1/09 419/8
6,437,292 B1 * 8/2002 Sikka ..... C21D 1/09 219/386
6,667,111 B2 * 12/2003 Sikka ..... C21D 1/34 428/610
6,822,197 B1 * 11/2004 Mattfield ..... B44D 3/168 219/541
7,683,292 B2 * 3/2010 Cavada ..... F24C 7/04 219/391
8,193,514 B2 * 6/2012 Ferraro ..... B05D 3/067 250/455.11
8,314,368 B2 * 11/2012 Ranish ..... H01L 21/324 219/405
8,442,391 B2 * 5/2013 Ericson ..... B44D 3/168 392/410
2003/0145679 A1 * 8/2003 Sikka ..... C21D 1/09 75/228
2004/0096202 A1 * 5/2004 Konishi ..... H05B 3/008 392/407
2006/0225770 A1 * 10/2006 Nowack ..... B44D 3/166 134/19
2007/0280654 A1 * 12/2007 Ericson ..... B08B 7/0071 392/410
2016/0311248 A1 * 10/2016 Ericsson ..... B44D 3/168

* cited by examiner

PAINT REMOVAL UNIT

CROSS-REFERENCE TO RELATED APPLICATIONS

This application claims priority to U.S. Provisional Application No. 62/826,054, which was filed on Mar. 29, 2019 and is incorporated herein by reference.

TECHNICAL FIELD

This disclosure relates to a system and method for removal of coatings, such as paint, from a surface using heat.

BACKGROUND

Materials such as masonry, concrete, and metal may be used in the construction of buildings, bridges, and roads, for example. These and other structures may have coatings such as paint. It can be difficult to remove coatings from these structures without damaging the underlying material structurally and/or aesthetically. Some known coating removal systems utilize mechanical stripping, such as grinding or abrasive blasting off the coating. Other known systems utilize chemicals to remove coatings.

SUMMARY

In one exemplary embodiment, a system for coating removal comprises a frame having a platform extending within the frame. A plurality of heat lamps are mounted on the platform. The plurality of heat lamps are arranged to provide a heat density of at least 40 watts per square inch.

In another exemplary embodiment, a method of removing a coating comprises arranging a unit having a plurality of heat lamps near a surface having a coating, and applying heat to the surface with the unit. The unit provides heat to an area of at least 4 square feet at a time.

DETAILED DESCRIPTION

Figure 1:
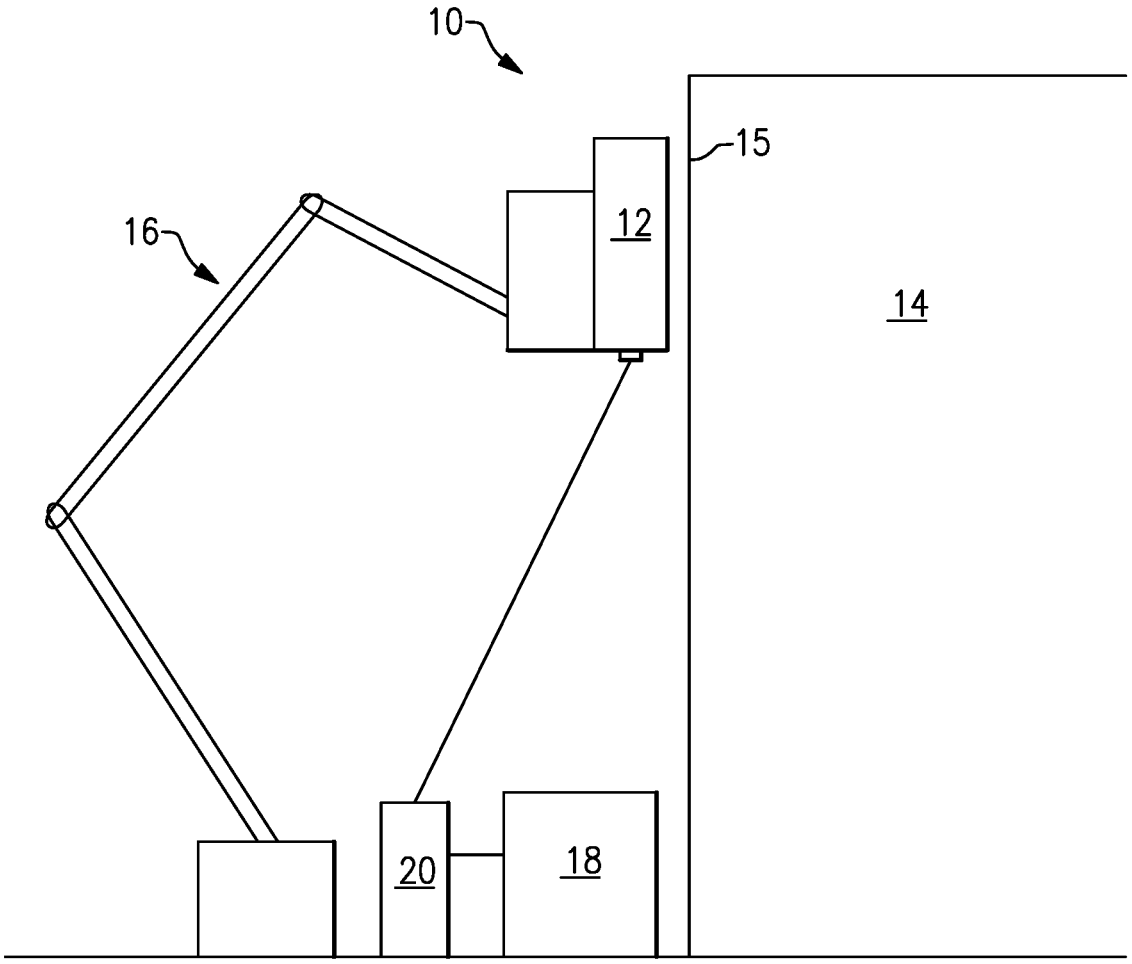
FIG. 1 schematically illustrates an exemplary coating removal system.

FIG. 1 schematically illustrates an exemplary coating removal system 10. The coating removal system 10 includes a coating removal unit 12 that is arranged near a structure, such as a building 14. Although a building 14 is illustrated, in other examples, the structure could be a bridge or road, for example. In the illustrated example, the coating removal unit 12 is arranged on a lift 16. In the illustrated example, the lift 16 is a boom lift. In other examples, the lift 16 may be a scissor lift, a mast lift, a scaffolding, or other structure. Although the coating removal unit 12 is illustrated on a lift 16, the coating removal unit 12 may also be used without a lift 16 for certain applications. The coating removal unit 12 is connected to a power source 18 through a control panel 20. The power source 18 may be a generator, for example.

The coating removal system 10 is used to bake paint or other coatings on the building 14. The power source 18 provides power to the paint removal unit 12, which then generates large amounts of heat. The coating removal unit 12 heats the surface 15 of the building 14. Coatings on the surface 15 of the building 14 may start to break down from the heat. These coatings may then fall off, or be easily removed. The coating removal system 10 may be used to remove paint, for example. The use of heat to break down the coating may avoid the need for harsh chemicals and thousands of gallons of water. Such harsh chemicals and water are used in some known systems to chemically break down the coating.

Figure 2:
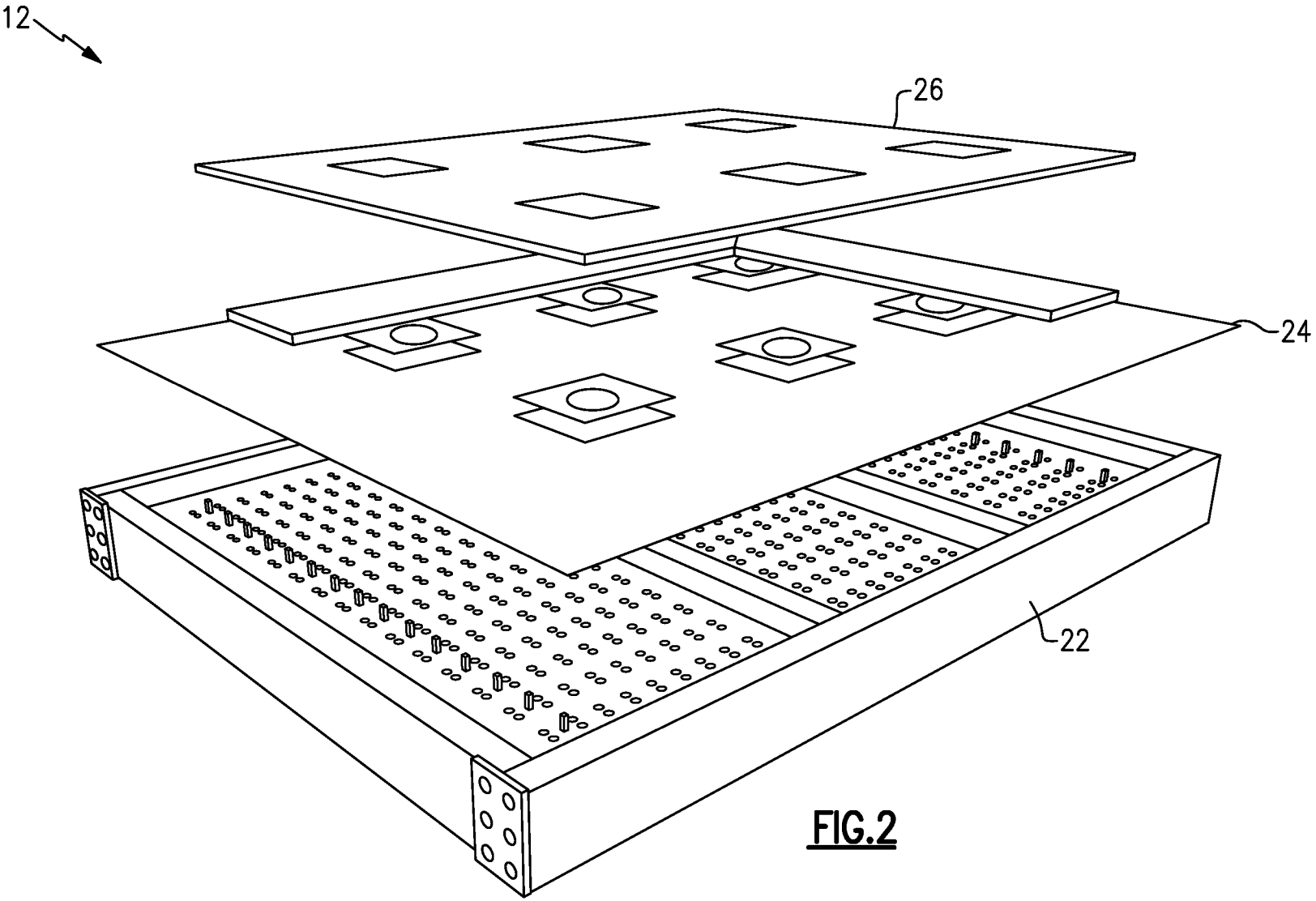
FIG. 2 schematically illustrates an exploded view of an exemplary coating removal unit.

FIG. 2 is an exploded view of an exemplary paint removal unit 12. The paint removal unit 12 generally provides a large amount of heat to a surface with a coating, such as paint. The heat breaks down the structure of the coating, allowing it to be easily removed. The exemplary paint removal unit 12 generally includes a frame 22, a fan tray 24, and a back plate 26. Each of these components will be described in more detail herein.

Figure 3:
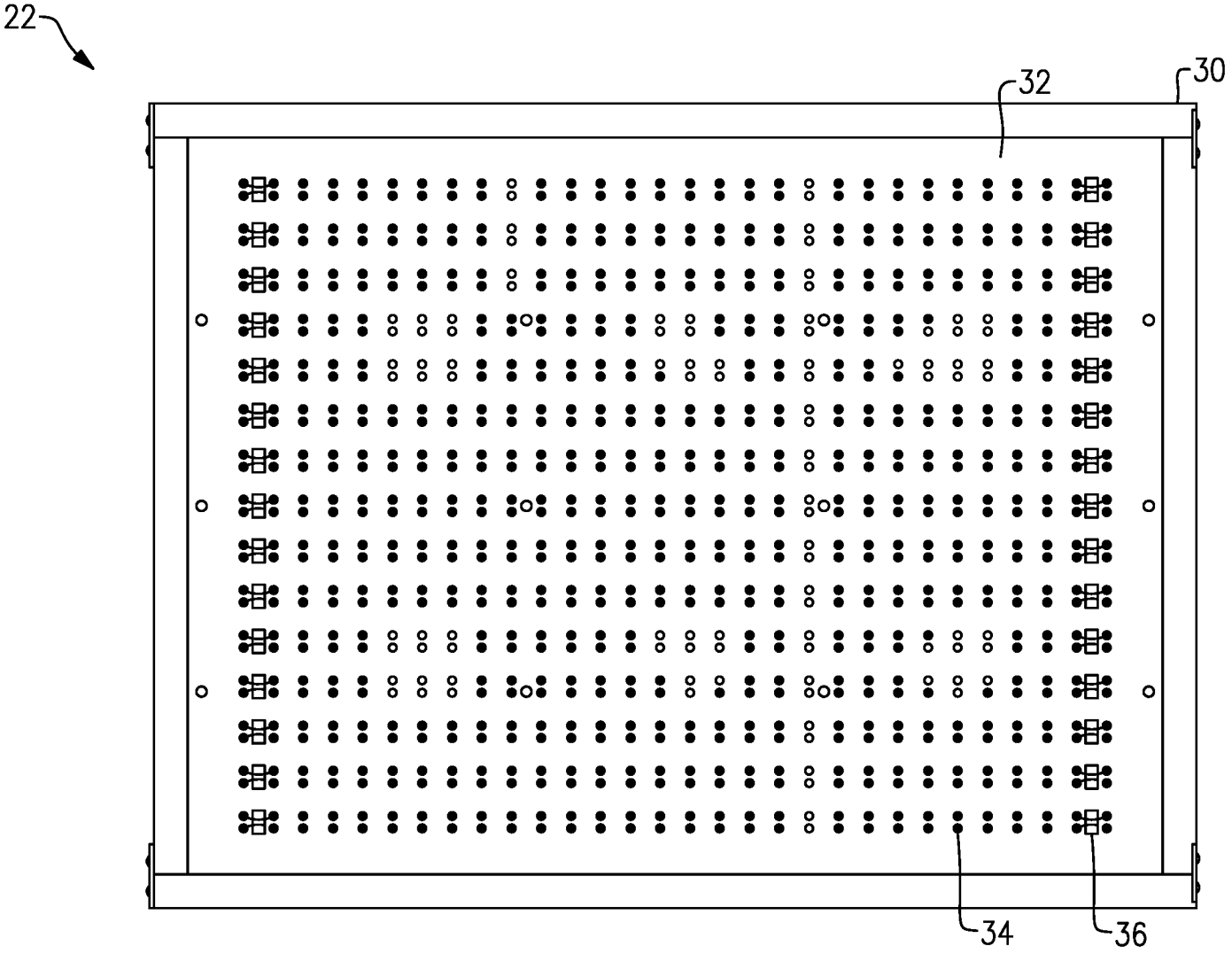
FIG. 3 illustrates an exemplary frame for the coating removal unit.

FIG. 3 illustrates the frame 22. The frame 22 is bounded by a rigid box 30 that bounds a platform 32. The box 30 may be formed from extruded aluminum, for example. According to one embodiment, the platform 32 is constructed of a conductive metal such as aluminum. In a further example, the platform 32 is a sheet of 3/16 inch aluminum. The frame may be about 52 by 40 inches, in one example. The platform 32 includes several perforations 34 and support brackets 36. The perforations 34 may be laser cut, for example. A plurality of electrical pins are arranged on the platform 32. The perforations 34 are arranged in rows extending along the platform 32. The frame 22 supports a plurality of heat lamps. In one example, the rows of perforations 34 are arranged to correspond to heat lamps or between the heat lamps.

According to some embodiments, the frame 22 may further be provided with a reflector to be set against the platform 32 on an opposite side from the support brackets 36. The reflector may be polished on a side opposite from the platform 32, and includes perforations to correspond to the perforations 34 of the platform 32. The reflector may reflect more heat towards the surface having a coating. However, in some cases, the reflector may be fouled more quickly than the platform 32. For example, off gasses from baked sealant may foul the reflector, so the reflector can be replaced on shorter intervals than the platform 32. In other examples, one side of the platform 32 may have a mirrored finish. This finish may help keep the platform 32 clean and reflect energy towards the surface to be baked.

Figure 4:
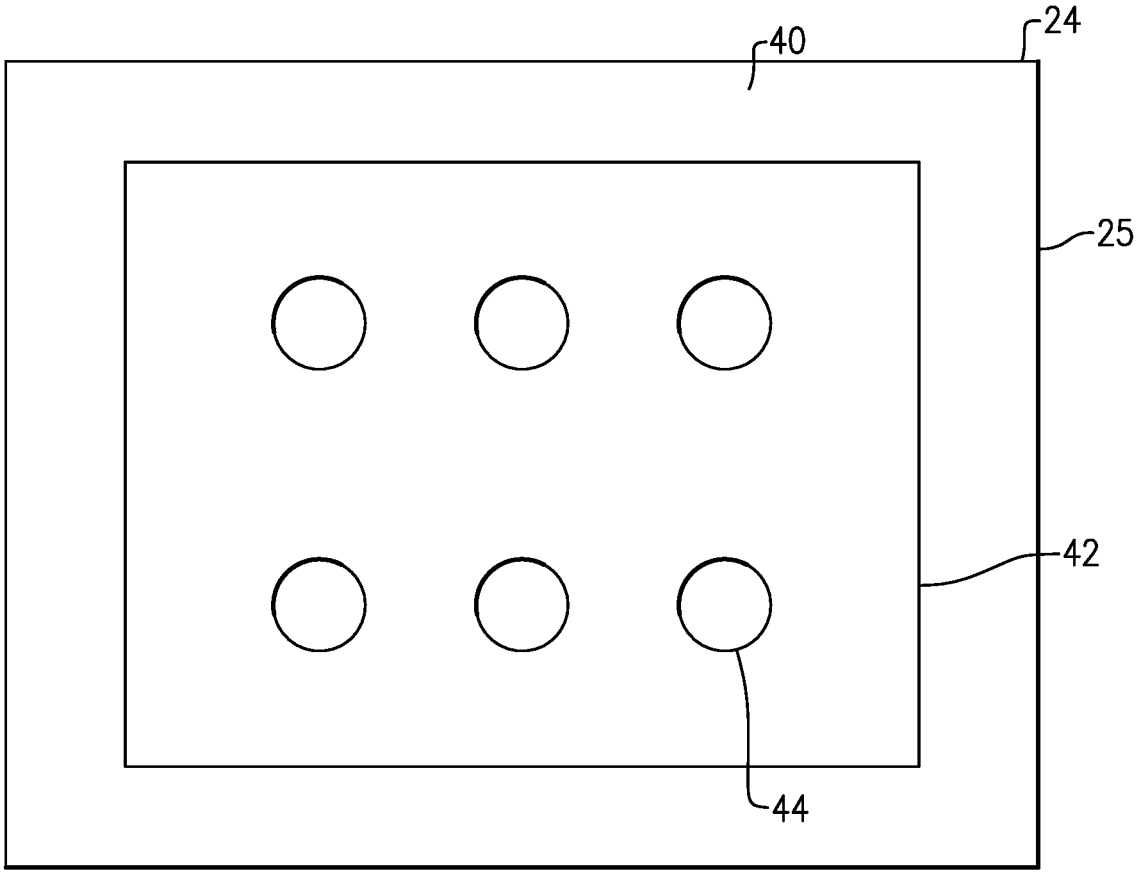
FIG. 4 illustrates an exemplary fan tray for the coating removal unit.

FIG. 4 illustrates a portion of the fan assembly 24. The fan assembly 24 is generally a tray 25 that includes a sheet 40 that supports a fan box 42. The sheet 40 includes holes 44 for fans. In the illustrated embodiment, the fans 46 (shown in FIG. 6B) and holes 44 are arranged into two rows that extend parallel to the rows of perforations 34 extending along the platform 32. In other words, the fans 46 and holes 44 are arranged into rows that extend parallel to the heat lamps to be supported by the frame 22. In the illustrated embodiment, the fan tray 25 has six fans. In another embodiment, the fan tray 25 has four fans. The fans pulls air in from behind the platform 32 and directs the air to cool the heat lamps.

Figure 5:
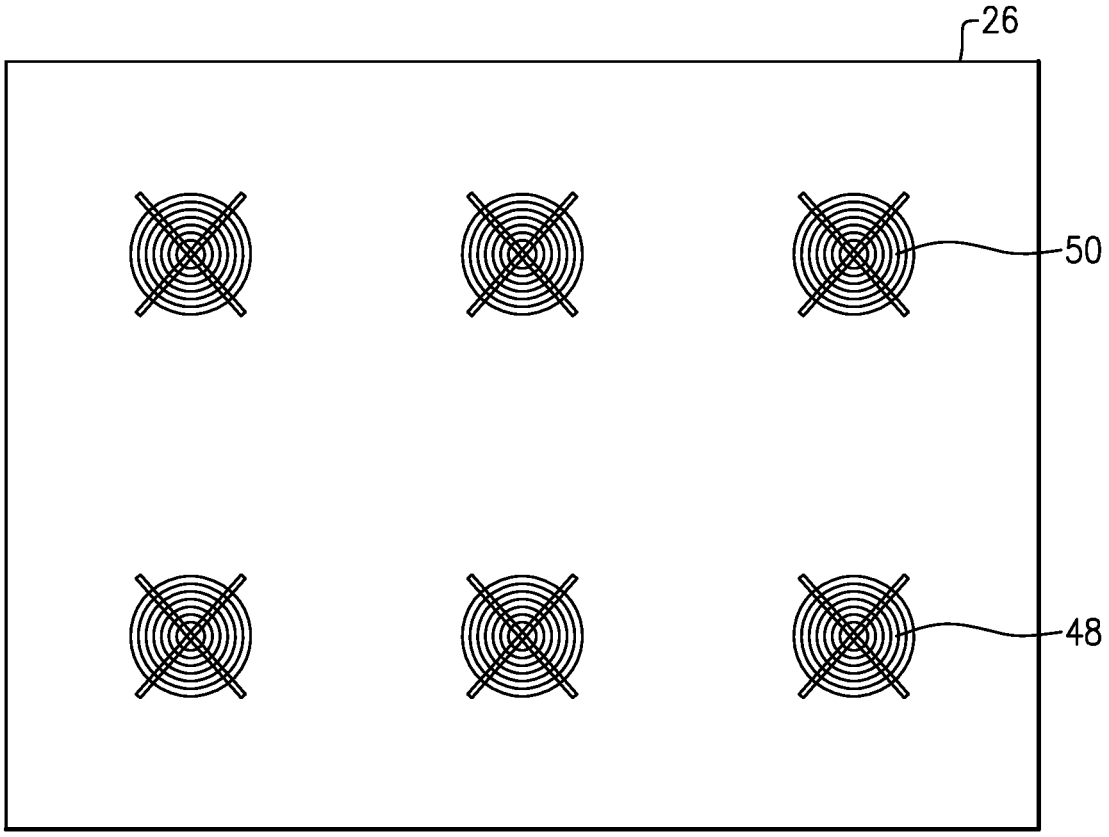
FIG. 5 illustrates an exemplary back plate for the coating removal unit.

FIG. 5 illustrates the back plate 26. The back plate 26 includes air supply openings 48 corresponding to the fans 46. The back plate 26 may be sheet metal or carbon fiber, for example. In the illustrated embodiment, the openings 44 each have a wire fan guard 50.

Figure 6A:
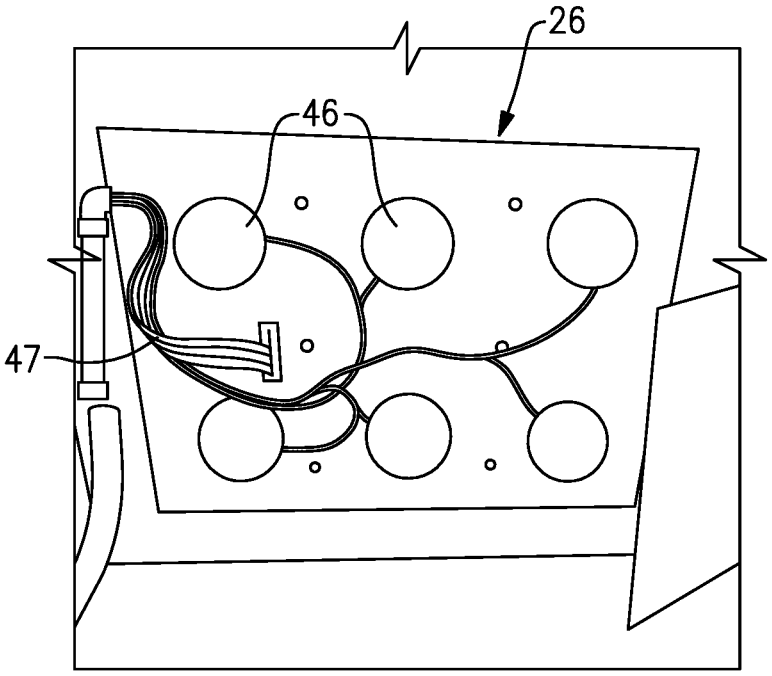
FIG. 6A illustrates a back view of the exemplary fan tray for the coating removal unit.

FIG. 6A illustrates the back plate 26 mounted to the coating removal unit 12. Each of the fans 46 are electronically connected to a power source via a wiring harness 47.

Figure 6B:
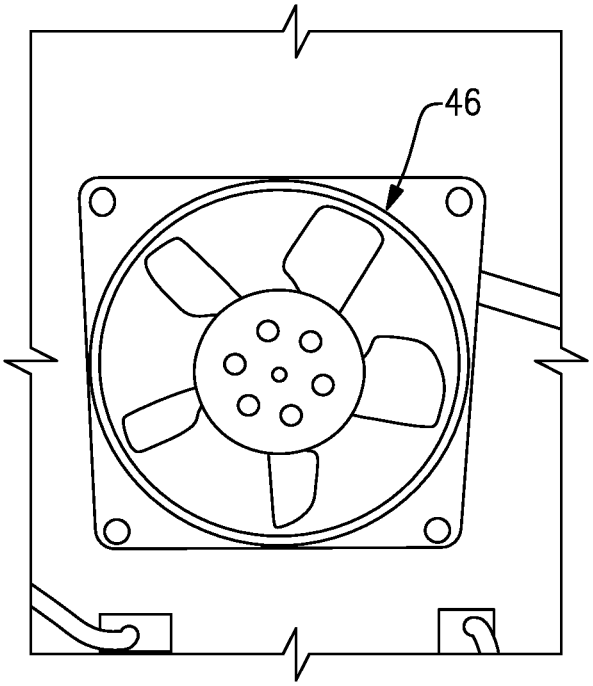
FIG. 6B illustrates an exemplary fan for the coating removal unit.

FIG. 6B illustrates an exemplary fan 46. In some examples, each of the fans 46 are the same type of fan. The fans 46 are axial fans. In some examples, a filter is arranged on the fan inlet. The filter may help prevent smoke by trapping dust and other particles. Although six fans 46 are illustrated, more or fewer fans 46 may be utilized within the scope of this disclosure.

The elements described above may be made from any of a variety of materials. In one example, each of the frame 22, tray 24, and back plate 26 may be constructed entirely or primarily of metal. The metal may be aluminum, steel, or some combination of metals or metal alloys. In another example, the frame 22, tray 24, and back plate 26 are constructed at least partially from ceramics, ceramic composites, or carbon fiber.

Figure 7A:
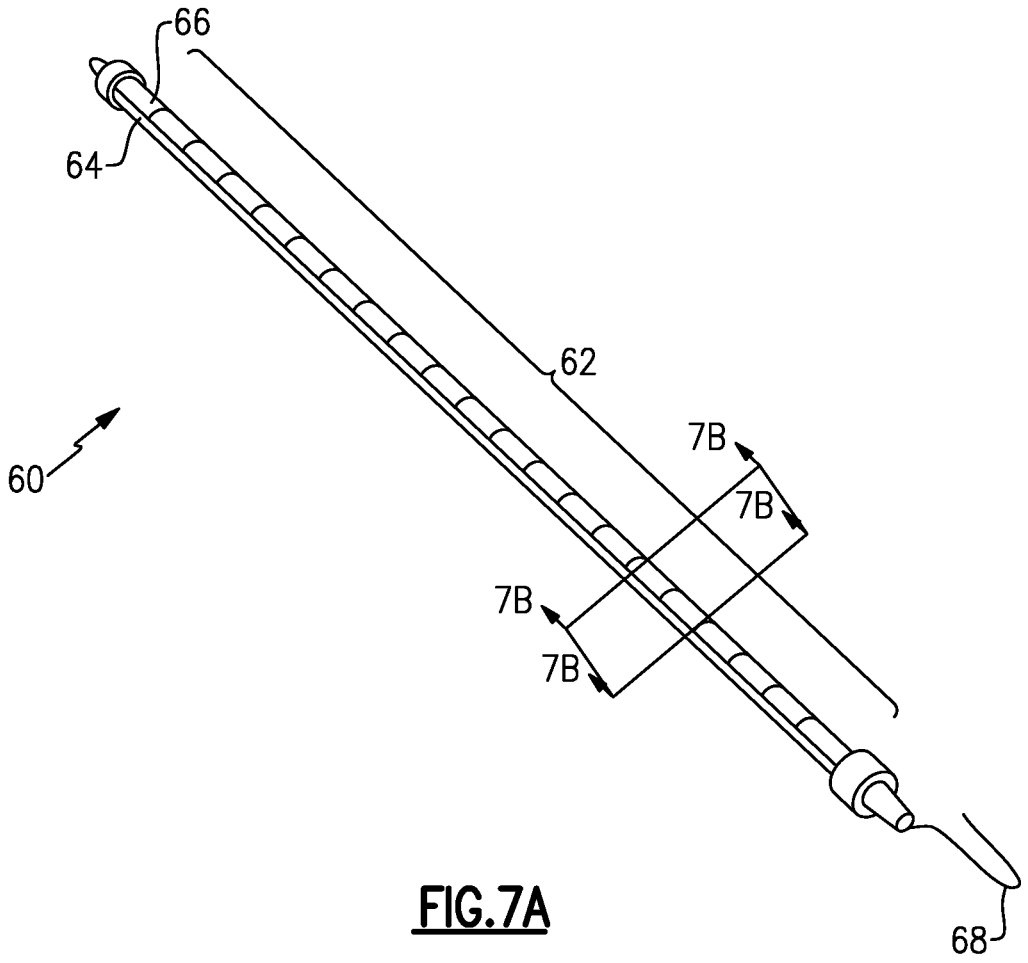
FIG. 7A illustrates an exemplary heat lamp for the coating removal unit.

Turning to FIG. 7A, an exemplary heat lamp 60 includes a tube 62 and two contacts 68 for connection with the frame 22. The tube 62 in turn includes an uncoated portion 64 and a coated portion 66. The coated portion 66 occupies approximately the same radial portion of the tube 62 along most of the tube's length 62. According to an exemplary embodiment, the tube is quartz and the coating includes a white oxide.

Figure 7B:
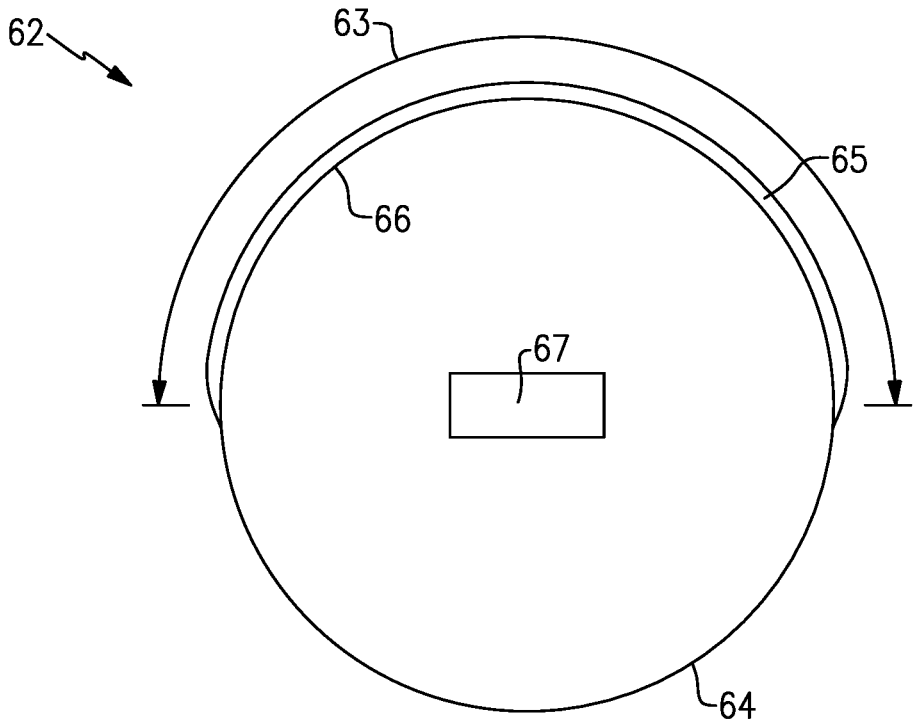
FIG. 7B shows a cross-sectional view of the heat lamp for the coating removal unit.

FIG. 7B is a schematic illustration of the tube 62 along cross-section 7B-7B of FIG. 7A. The coated portion 66 extends across a portion of the tube 62 to form an arc that subtends an angle 63. According to the illustrated embodiment, the angle 63 is approximately 180°. In another example, the angle 63 is smaller or larger, depending on the spacing of the lamps 60. The tube 62 may have a diameter of about 1.3 inches. A filament 67 extends through the tube 62. The filament 67 is of a material and configuration conducive to generating heat. In one example, the filament 67 is constructed at least partially from tungsten.

Figure 7C:
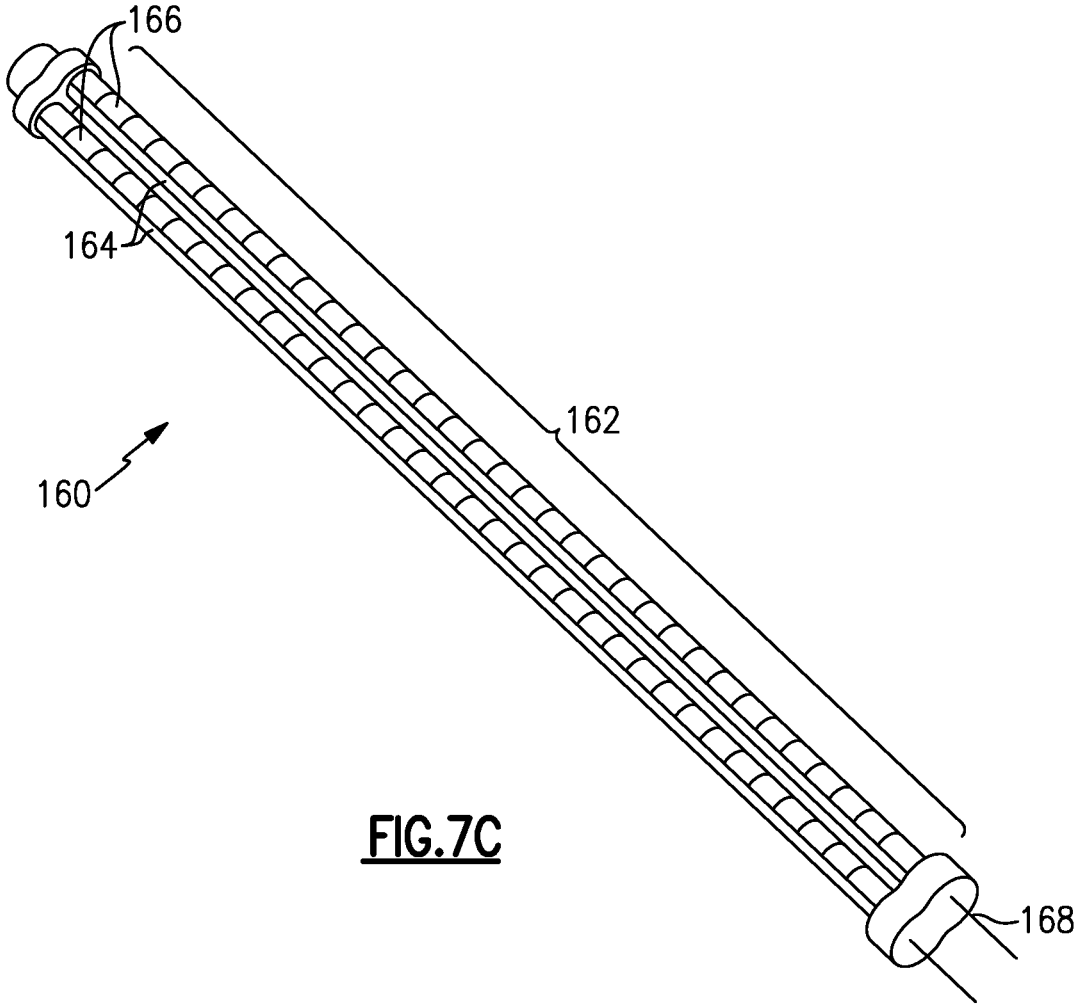
FIG. 7C illustrates another exemplary heat lamp for the coating removal unit.

The lamp 60 described above and illustrated in FIG. 7A is a single tube 62 lamp, but it should be understood that other configurations, such as a twin tube lamp, are contemplated. For example, a twin tube lamp 160 as illustrated in FIG. 7C may be used to provide one tube 162 per row of perforations 34. Each twin tube lamp 160 likewise includes tubes 162 with coated and uncoated portions 166, 164, and electrical contacts 168. In some embodiments, the unit 12 may include both single and twin tube lamps 60, 160.

Lamps 60, 160 according to certain exemplary embodiments are tube shortwave quartz infrared lamps. In further embodiments according the foregoing, the lamps 60, 160, the lamps operate at 8000 W, 3-phase 480V and may reach temperatures of up to about 4000° Fahrenheit. That is, in one example, the filament 67 in the lamps 60, 160 reaches about 4000° F., while the quartz reaches about 1200° F. The lamps 60, 160 may be 33 mm×15 mm clear quartz with a white oxide reflector coating. Each lamp 60, 160 has a crimped metal connection on ends of the lead wires for connection to the unit 12.

A plurality of lamps 60, 160 are arranged in the frame 22 to provide heat over an area. For example, the lamps 60, 160 may be arranged horizontally, supported by the support brackets 36. In another example, the lamps 60, 160 may be arranged vertically. In one example, the lamps 60, 160 are arranged to provide heat over an area between about 4 and 64 square feet. In a further embodiment, the lamps 60, 160 are arranged to provide heat over an area of about 4 ft×4 ft. The lamps 60, 160 may be arranged to provide heat over a square or rectangular area, for example. The lamps 60, 160 have about 40 inches of heated length, in one example. In one example, the lamps 60, 160 operate at about 100 watts per inch per tube, so 100 watts per inch for a single tube lamp 60 and 200 watts per inch for a double lamp 160. Thus, a 40 inch double tube lamp 60 operates at 8000 watts. The unit 12 may include 15 lamps 160. Thus, the unit 12 operates at 120 kW. The power source 18 may provide about 200 kW to the unit 12.

The disclosed unit 12 provides a much larger amount of heat over a larger area than known systems. The lamps 60, 160 are spaced to provide a large amount of heat over an area. In one example, the lamps 60, 160 are spaced such that the unit 10 provides a heat density between about 40 and 200 Watts per square inch. In a further example, the unit 10 provides a heat density between about 75 and 200 W/in$^2$. In a further embodiment, the unit 12 provides about 144 W/in$^2$.

Figure 8B:
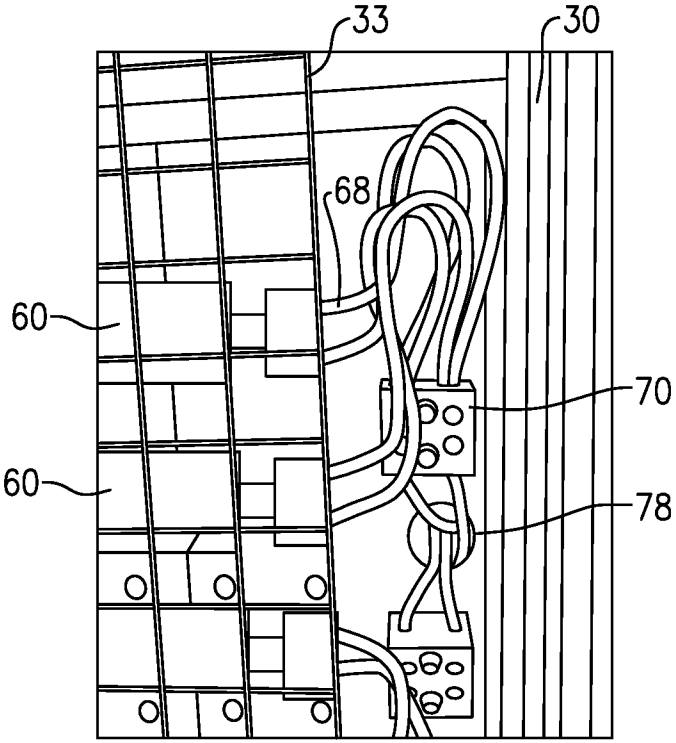
FIGS. 8A and 8B illustrate a front view of the coating removal unit.
Figure 8A:
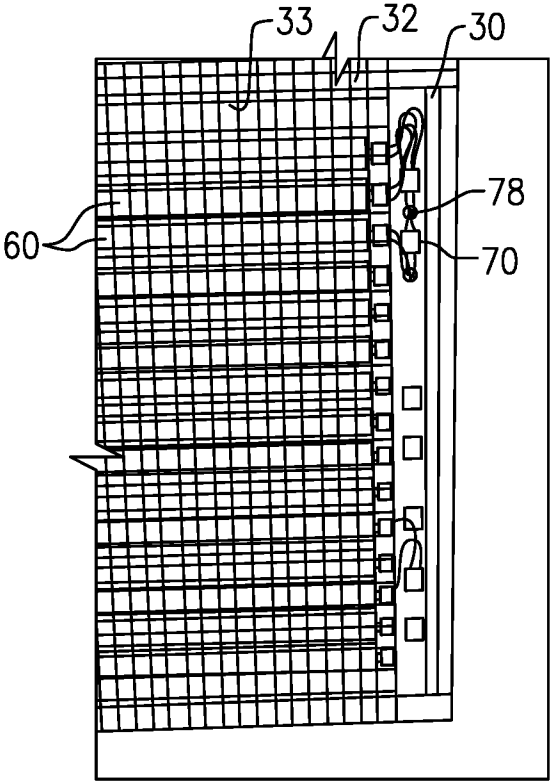

FIGS. 8A and 8B illustrate a front view of the coating removal unit. Each of the heat lamps 60 is mounted in front of the platform 32 of the rigid box 30. A plurality of terminal blocks 70 are arranged between the box 30 and the lamps 60. The lamps 60 are wired via the terminal blocks 70. The terminal blocks 70 may be ceramic, for example. In one example, five lamps 60 are wired to each terminal block 70. Wires then extend from the terminal block 70 through a hole 78 in the platform 32 and to the control panel 20. A wire grid 33 may be arranged in front of the heat lamps 60 opposite the platform 32. The wire grid 33 may extend substantially parallel to the platform 32, for example. In one example, the wire grid 33 is formed from stainless steel. Each of the heat lamps 60 is connected to a power source via a wiring harness 68.

Figure 9:
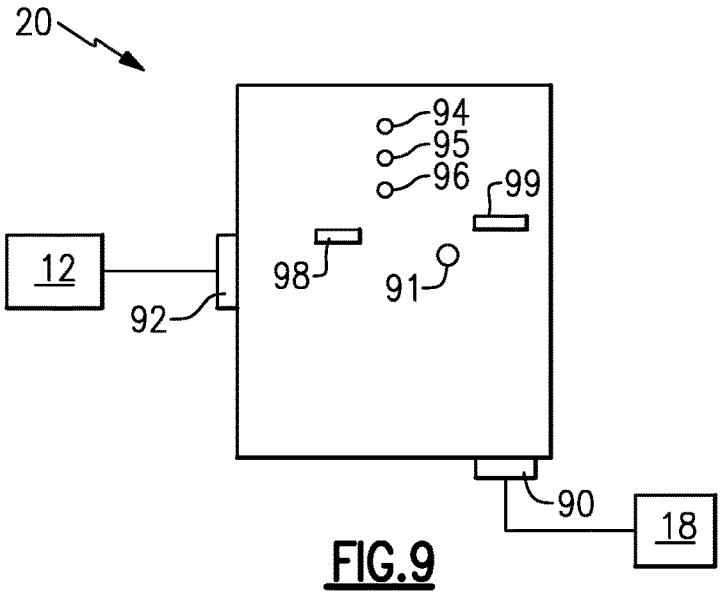
FIG. 9 illustrates an example control panel for the coating removal system.

FIG. 9 illustrates an example control panel 20. The control panel 20 may include a silicon controlled rectifier (SCR), for example. The control panel 20 has a first plug 90 which connects to the power source 18, and a second plug 92 which connects to the unit 12. The plugs 90, 92 are connected via a heavy duty cable, for example. The cable may be weatherproof. An emergency stop button 91 may be located on the control panel 20. The emergency stop 91 shuts off the power to the unit 12. A plurality of indicator lights 94, 95, 96 are arranged on the control panel 20. In one example, the light 94 is a main power light that illuminates when the control panel 20 is receiving power from the power source 18. The light 95 is illuminated when the unit 12 is powered on. The light 96 is a check fan light, which illuminates when the control panel 20 detects a potential fault in the fan assembly 24. In one example, the control panel 20 detects a fault in the fan assembly 24 based on the amount of current going to the fan assembly 24. A potentiometer 98 may be used to permit an operator to change the voltage. In one example, the potentiometer 98 permits the unit 12 to be used between 1% and 99% of the voltage supplied by the power source 18. A handle 99 permits access to the interior of the control panel 20. The control panel 20 may further include cooling fans and a vent.

Although a particular control panel 20 is shown, other arrangements may be used. In one example, the control panel 20 may include a screen to display system information to an operator. The screen may be a touchscreen to permit the operator to adjust the voltage or monitor the system. In some examples, the control panel 20 may communicate with a remote user interface to permit an operator to adjust voltage or monitor the system from a different locations, such as via a smart phone application.

Figure 10:
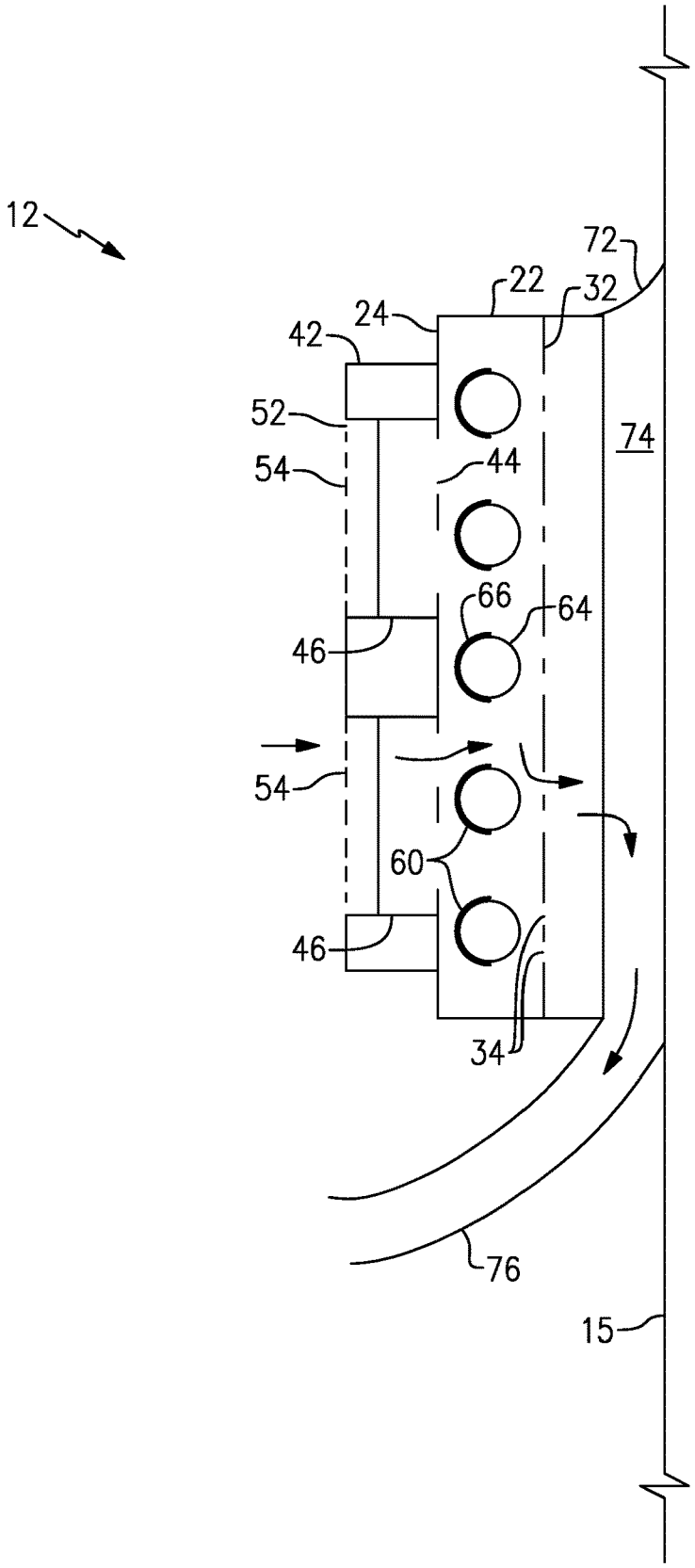
FIG. 10 schematically illustrates a cross-section of the coating removal unit.

FIG. 10 is a schematic cross-sectional illustration of an assembled unit 12 applied to a surface 15. According to one example, the surface 15 is a surface of a concrete masonry unit (CMU) wall. The surface 15 is at least partially coated with a coating, such as paint. The coating may be an elastomeric paint, for example. The unit 12 is at least partially sealed against the surface 15 by a gasket 72. The gasket 72 extends around a perimeter of the frame 22 to create an enclosed heated space 74.

The assembled unit 12 is arranged to heat the surface 15. The lamps 60 are arranged parallel to the surface 15 and oriented so the uncoated portions are directed toward the platform 32 and surface 15. The fans 46 blow air past the lamps 60 and onto the platform 32. The frame 22, fan tray 25, and back plate 26 as assembled create an enclosure, so most of the air drawn in by the fans 46 is forced through the perforations 34, which maintains the temperature of the platform 32 and helps cool the unit 12 after operation.

According to one example, the surface 15 is heated to between 500° and 925° Fahrenheit. The surface 15 is further heated convectively by air blown by the fans 46 through the perforations 34. The heating of the surface 15 bakes off the paint. The baked paint results in smoke and fumes, which are largely contained in the heated space 74 by the gasket 72. The heated space 74 is exhausted to an evacuator 76. According to one example, the evacuator 76 is connected to any of a filter, vent, pump, and fan.

Although FIG. 10 and the associated description above refer to a tube lamp 60, further embodiments include twin tube lamps 160 in addition or instead.

Figure 11:
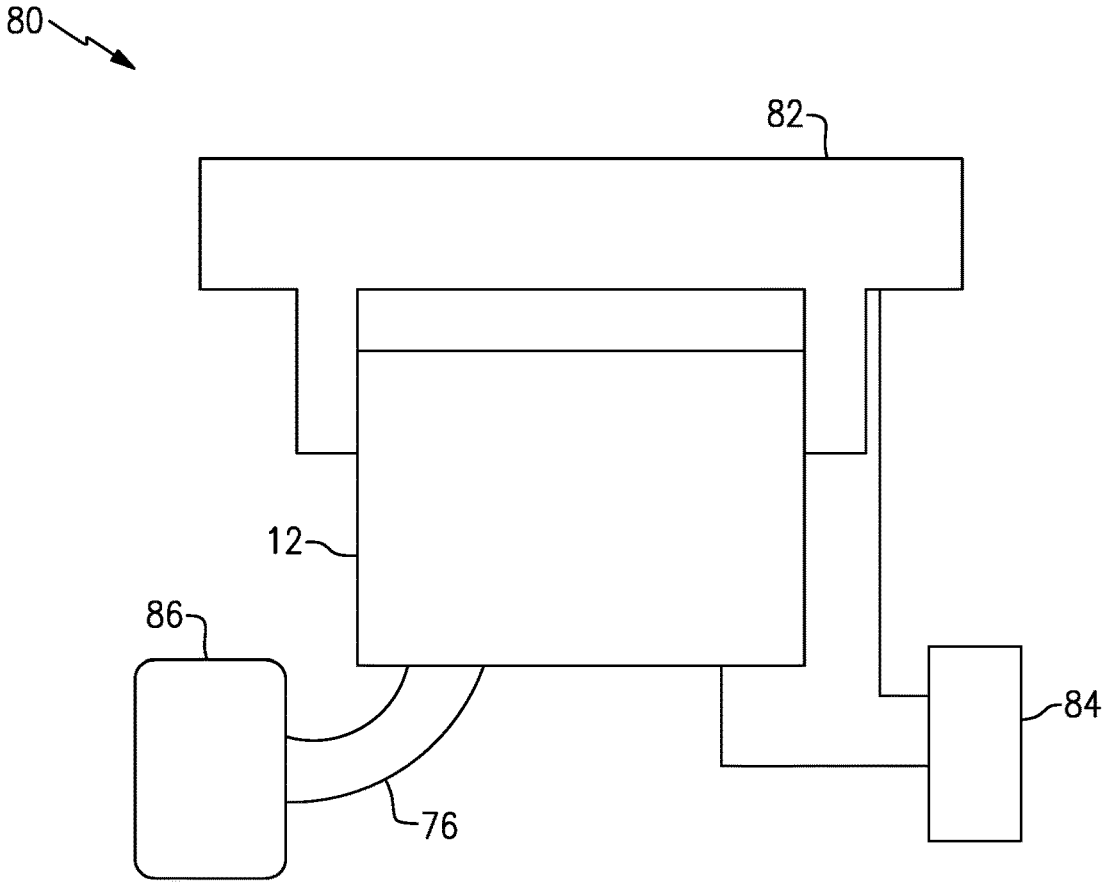
FIG. 11 schematically illustrates the exemplary coating removal system.

FIG. 11 schematically illustrates a system 80 including the unit 12. The unit 12 is supported by a conveyance 82. The conveyance 82 and unit 12 are both connected to controls 84, which in some embodiments may include a power supply. Controls 84 is used generally here, and it should be understood that the unit 12 and conveyance 82 may be governed by discrete control and power systems. The unit 12 is powered by a generator. In some examples, the generator provides between 50 and 200 kW. In a further embodiment, the generator provides about 98 kW. In other embodiments, other power generation systems may be used to provide power to the unit 12.

In some examples, a metering device, such as a potentiometer, is connected to the unit 12 to permit it to be operated at less than maximum output. For example, if the maximum output is achieved by supplying 480 volts, the unit 12 may be run at lower voltages. Running the unit 12 below maximum output may be useful to warm up before use, permit checking of the components in the unit 12, and may protect the unit 12 from unexpected voltage spikes.

In some examples, an electrical panel is used to control the power transmitted between the generator and the unit 12. The panel may be waterproof and contain waterproof components, in one example. The unit 12 and generator are connected via cables. In one example, these cables are SJ cord. The cables may 6000 volt cables, for example.

A method of using the described system 80 and unit 12 includes positioning the unit 12 near a surface having a coating and turning on the unit 12 to apply a large amount of heat to the surface. Heat is applied to the surface for a period of time to weaken the coating, then the coating is swept off the surface. In some examples, after the heat is applied, the coating is removed using compressed air. In other examples, the compressed air may include a small amount of abrasive material. In other examples, the coating is swept off using a tools such as a scraper or brush.

The disclosed system and method provides a new way to remove coatings, such as paint, from large surfaces. Some known mechanical strippers, such as grinders or vapor blasting, can damage the underlying surface. Some known chemical strippers can cause environmental problems when used over a large outdoor surface. The disclosed system and method uses heat to damage the coating for easier removal. The system provides a large quantity of heat over a large area for removal of coatings from large surfaces, such as building exteriors.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A system for coating removal, comprising:
a frame having a platform extending within the frame;
a plurality of heat lamps mounted on the platform, wherein the plurality of heat lamps are arranged to provide a heat density to a wall of between about 40 and 195 watts per square inch, wherein the plurality of heat lamps are configured to heat the wall to between 500° and 925° Fahrenheit; and
a plurality of fans mounted behind the platform and positioned to direct air across the plurality of heat lamps and the platform to the coating on the wall to heat the coating for removal.

2. The system of claim 1, wherein the heat lamps and the fans are configured to receive between 50 and 300 kW of power from an external power source via a control panel, the control panel is remote from the frame.

3. The system of claim 1, wherein the fans are configured to direct air toward the heat lamps.

4. The system of claim 1, wherein the platform contains a heat conductive material.

5. The system of claim 1, wherein at least one of the plurality of heat lamps is a shortwave quartz infrared lamp.

6. The system of claim 1, wherein each of the plurality of heat lamps is an elongate tube having an electrical connection on at least one end of the elongate tube.

7. The system of claim 6, wherein each of the plurality of heat lamps has a coated portion and an uncoated portion, the coated and uncoated portions both extending along a length of the elongate tube.

8. The system of claim 1, wherein the plurality of heat lamps are configured to provide heat to an area of between about 4 and about 64 square feet.

9. The system of claim 1, wherein the plurality of heat lamps are configured to provide a heat density of between about 120 and 156 watts per square inch.

10. The system of claim 1, wherein the frame is arranged on a lift.

11. The system of claim 1, wherein the platform comprises a heat conductive metal and includes a plurality of perforations for allowing air from the fans to flow across the plurality of heat lamps and the platform to the coating.

12. A system for coating removal, comprising:

a frame having a platform extending within the frame; and a plurality of heat lamps mounted on the platform, the plurality of heat lamps are configured to provide heat to a concrete surface, each of the plurality of heat lamps is an elongate tube having an electrical connection on at least one end of the elongate tube, wherein the plurality of heat lamps are arranged to provide a heat density of between about 120 and 156 watts per square inch;

at least four fans mounted behind the platform and positioned to direct air across the platform to the concrete surface; and a control panel remote from the frame, the control panel configured to meter power from an external power source to the heat lamps and the fans, the control panel having at least one indicator light, and configured to permit an operator to select a voltage supplied by the power source.

13. The system of claim 12, wherein the platform comprises a heat conductive metal and a plurality of perforations for allowing the air from the fans to flow across the plurality of heat lamps and the platform to the concrete surface.

* * * * *